US008312900B2

(12) United States Patent
Hack-Ueberall et al.

(10) Patent No.: US 8,312,900 B2
(45) Date of Patent: Nov. 20, 2012

(54) FORMING FABRIC

(75) Inventors: Petra Hack-Ueberall, Reutlingen (DE); Arved H. Westerkamp, Dettingen/Erms (DE)

(73) Assignee: Voith Patent GmbH, Heidenheim (DE)

( * ) Notice: Subject to any disclaimer, the term of this patent is extended or adjusted under 35 U.S.C. 154(b) by 428 days.

(21) Appl. No.: 12/727,887

(22) Filed: Mar. 19, 2010

(65) Prior Publication Data

US 2010/0236741 A1 Sep. 23, 2010

Related U.S. Application Data

(63) Continuation of application No. PCT/EP2008/062402, filed on Sep. 18, 2008.

(30) Foreign Application Priority Data

Sep. 21, 2007 (DE) ..... 10 2007 046 113

(51) Int. Cl.

| | |
|---|---|
| ***D21F 1/10*** | (2006.01) |
| ***D21F 7/08*** | (2006.01) |
| ***D03D 3/04*** | (2006.01) |
| *D03D 25/00* | (2006.01) |

(52) U.S. Cl. ..... 139/383 A; 139/383 AA; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | |
|---|---|---|---|---|
| 4,041,989 | A * | 8/1977 | Johansson et al. | 139/425 A |
| 4,515,853 | A | 5/1985 | Borel | |
| 4,554,953 | A | 11/1985 | Borel et al. | |
| 5,152,326 | A | 10/1992 | Vohringer | |
| 6,533,901 | B2 * | 3/2003 | Taipale | 162/348 |
| 7,249,615 | B2 * | 7/2007 | Westerkamp et al. | 139/383 A |
| 7,270,152 | B2 * | 9/2007 | Ueda et al. | 139/383 A |
| 7,415,993 | B2 * | 8/2008 | Hay et al. | 139/383 A |
| 7,426,943 | B2 * | 9/2008 | Ueda et al. | 139/383 A |
| 7,426,944 | B2 * | 9/2008 | Danby et al. | 139/383 A |
| 7,431,802 | B2 * | 10/2008 | Quigley et al. | 162/348 |
| 7,503,350 | B2 * | 3/2009 | Quigley | 139/383 A |
| 7,571,746 | B2 * | 8/2009 | Hay et al. | 139/383 A |
| 7,604,025 | B2 * | 10/2009 | Quigley | 139/383 A |
| 7,637,291 | B2 * | 12/2009 | Boeck | 139/383 A |
| 7,743,795 | B2 * | 6/2010 | Quigley | 139/383 A |
| 7,775,243 | B2 * | 8/2010 | Hack-Ueberall et al. | 139/383 A |
| 7,861,747 | B2 * | 1/2011 | Quigley | 139/383 A |
| 7,866,350 | B1 * | 1/2011 | Quigley | 139/383 A |
| 8,141,595 | B2 * | 3/2012 | Quigley | 139/383 A |
| 8,176,944 | B2 * | 5/2012 | Westerkamp | 139/383 A |

(Continued)

FOREIGN PATENT DOCUMENTS

EP 0408849 A2 1/1990

(Continued)

*Primary Examiner* — Bobby Muromoto, Jr.
(74) *Attorney, Agent, or Firm* — Taylor IP, P.C.

(57) ABSTRACT

The present invention relates to a paper machine fabric, especially a forming fabric, including a top woven fabric layer and a bottom woven fabric layer which are connected with each other by paired binder yarns. The present invention is characterized in that at least one of the binder yarn pairs is formed by machine direction yarns (binding machine direction yarns) and at least one of the other binder yarn pairs is formed by cross machine direction yarns (binding cross machine direction yarns).

25 Claims, 13 Drawing Sheets

U.S. PATENT DOCUMENTS

| | | | | |
|---|---|---|---|---|
| 2004/0182465 | A1* | 9/2004 | Ward | 139/383 A |
| 2006/0016505 | A1* | 1/2006 | Westerkamp | 139/383 A |
| 2006/0016509 | A1* | 1/2006 | Westerkamp et al. | 139/383 R |
| 2006/0048840 | A1* | 3/2006 | Quigley | 139/408 |
| 2006/0243339 | A1 | 11/2006 | Hay | |
| 2006/0249220 | A1* | 11/2006 | Barrett et al. | 139/383 A |
| 2007/0028996 | A1* | 2/2007 | Quigley | 139/383 R |
| 2007/0095417 | A1* | 5/2007 | Fujisawa | 139/383 A |
| 2008/0035230 | A1* | 2/2008 | Danby et al. | 139/383 A |
| 2008/0035231 | A1* | 2/2008 | Hay et al. | 139/420 B |
| 2008/0149213 | A1* | 6/2008 | Quigley | 139/408 |
| 2008/0149214 | A1* | 6/2008 | Quigley | 139/410 |
| 2009/0035537 | A1* | 2/2009 | Hack-Ueberall et al. | 428/196 |
| 2009/0205740 | A1* | 8/2009 | Quigley | 139/408 |
| 2009/0283233 | A1* | 11/2009 | Boeck et al. | 162/202 |
| 2010/0236741 | A1* | 9/2010 | Hack-Ueberall et al. | 162/289 |
| 2012/0160439 | A1* | 6/2012 | Boeck et al. | 162/202 |

FOREIGN PATENT DOCUMENTS

| | | | |
|---|---|---|---|
| EP | 1002892 | A1 | 5/2000 |
| EP | 1605095 | A1 | 12/2005 |
| WO | 2005014926 | A1 | 2/2005 |
| WO | 2006020414 | A1 | 2/2006 |

* cited by examiner

X Crossover point for the structural warp yarn binder pair

O Crossover point for the structural weft yarn binder pair

FORMING FABRIC

CROSS REFERENCE TO RELATED APPLICATIONS

This is a continuation of PCT application No. PCT/EP2008/062402, entitled "FORMING SCREEN", filed Sep. 18, 2008, which is incorporated herein by reference.

BACKGROUND OF THE INVENTION

1. Field of the Invention

The present invention relates to a paper machine fabric, especially a forming fabric.

2. Description of the Related Art

In the known multi-layer paper machine fabrics, two woven fabric layers are held together either with binding machine direction or cross machine direction yarns. While running in the paper machine, sections of a paper machine fabric are under severe longitudinal tension. The paper machine fabric therefore stretches in its longitudinal direction (machine direction) and contracts in its width (cross machine direction).

In paper machine fabrics whose woven fabric layers are connected with each other by cross machine direction binder yarns, there exists the problem that the connection between the woven fabric layers loosens due to the contraction of the fabric in a cross machine direction, causing the internal friction between the woven layers to intensify. A strong internal friction between the woven fabric layers leads to a premature wear of the paper machine fabric and, thereby, often to a shortened lifespan.

In paper machine fabrics whose woven fabric layers are connected with each other by machine direction binder yarns, there exists the problem that the binder yarns are heavily stretched due to the stretching of the fabric in the machine direction. This leads to a constriction at the crossover points of the binder yarns and, therefore, to a constriction and an unevenness in the paper-side woven fabric layer. If, in contrast, the machine direction binder yarns are woven so loosely that the problem described above cannot occur, then the sections of woven fabric layers in which the fabric is under a slight longitudinal tension are not connected firmly enough with each other, causing an internal friction of the forming fabric.

What is needed in the art is a paper machine fabric with improved strength and minimal internal friction in which the aforementioned disadvantages are prevented.

SUMMARY OF THE INVENTION

The present invention provides a papermaking machine fabric, also known as a paper machine fabric, especially a forming fabric including a top woven fabric layer and a bottom woven fabric layer which are connected with each other by paired binder yarns and whereby at least one of the binder yarn pairs is formed by machine direction yarns (binding machine direction yarns) and at least one of the other binder yarn pairs is formed by cross machine direction yarns (binding cross machine direction yarns). A combination of both binding systems enables the connection between the woven fabric layers to be adapted to the tension conditions of the paper machine fabric in the paper machine.

If the fabric is subjected to greater longitudinal tension, for example in the sheet formation area, then the connection of the woven fabric layer by means of the binding cross machine yarns is not ensured to the required extent. In this case, the binding machine-direction yarns assume the secure connection between the woven fabric layers. As soon as the forming fabric exits the aforementioned area of increased longitudinal tension, the forming fabric width increases again and the secure connection between the woven fabric layers is again provided by the binding cross machine direction yarns. A loosening of the binding machine-direction yarns due to the decrease in the longitudinal tension therefore does not play a part.

A first embodiment of the present invention provides that each of the binder yarn pairs provides an upper weave path during weaving of the top woven fabric layer, whereby the two binder yarns of the binder yarn pair alternate during weaving of the top and the bottom woven fabric layer so that—while the first binder yarn of the binder yarn pair weaves the top woven fabric layer, the second binder yarn of the binder yarn pair weaves the bottom woven fabric layer and—while the second binder yarn of the binder yarn pair weaves the top woven layer, the first binder yarn weaves the bottom woven fabric layer and the two binder yarns of the binder yarn pair cross each other, thereby forming crossover points when the first binder yarn crosses over from interweaving of the top woven fabric layer to interweaving of the bottom woven fabric layer and the second binder yarn crosses over from interweaving of the bottom woven fabric layer to interweaving of the top woven layer, or vice versa. In this case, each binder yarn of the binder yarn pair in particular interweaves with several yarns during weaving of the top woven fabric layer before this binder yarn crosses over to weaving of the bottom fabric layer.

According to a second embodiment of the present invention, the top woven fabric layer provides the paper side and the bottom woven fabric layer provides the machine side of the paper machine fabric. Several options as to how the top woven fabric layer may be formed are conceivable. According to a first option the top woven fabric layer is formed only through interweaving of binding machine direction yarns with binding cross machine direction yarns. In order to increase the wear resistance of the paper machine fabric according to the present invention, it may be useful if the bottom woven fabric layer includes lower cross machine direction yarns which are interwoven with binding machine-direction yarns and with the lower machine-direction yarns. In addition, it is conceivable that the bottom woven fabric layer includes lower machine direction yarns which are interwoven with binding cross machine direction yarns and with lower cross machine direction yarns.

If the bottom woven fabric layer includes lower cross-machine direction yarns as well as lower cross machine-direction yarns then the bottom woven fabric layer is formed in that the lower machine direction yarns, the lower machine direction yarns, the binding cross machine direction yarns and the binding machine direction yarns are interwoven with each other.

It is also conceivable that the top woven fabric layer includes, in addition to the binding machine direction and cross machine direction yarns, upper machine direction yarns and upper cross machine direction yarns which are interwoven with each other and with the binding cross machine direction yarns and with the binding machine direction yarns. The interweaving of the binder yarns in particular continues a weaving pattern which is formed by interweaving the upper machine direction yarns with the upper cross machine direction yarns. Such binder yarns are known as "structure forming" yarns. In this scenario, the weaving pattern which is formed by the upper yarns is not interrupted by the binder yarns, but is instead continued by the binder yarns.

A third embodiment of the present invention provides that the bottom woven fabric layer includes lower machine direction yarns and lower cross machine direction yarns, whereby the lower machine direction yarns are interwoven with lower cross machine direction yarns and with binding cross machine direction yarns and whereby the lower cross machine direction yarns are interwoven with lower machine direction yarns and with binding machine direction yarns.

A concrete advancement of the present invention further provides that the binding machine direction yarns may be interwoven with upper cross machine direction yarns, with lower cross machine direction yarns and with binding cross machine direction yarns and/or that the binding cross machine direction yarns are interwoven with upper machine direction yarns, with lower machine direction yarns and with binding machine direction yarns.

It is also feasible for a multitude of applications if at least one upper machine direction yarn is arranged between two consecutive machine direction binder yarn pairs. Here, it is feasible that no more than three upper machine direction yarns are arranged between consecutive machine direction binder yarn pairs. On the one hand, this provides an top woven fabric layer with a uniform structure. In addition, the tension occurring in the machine direction does not only have to be absorbed by the machine direction binder yarn pairs, but is also absorbed partially by the upper machine direction yarns. Further, a distance between the machine direction binder yarn pairs, which is not too large, is provided so that a secure connection between the woven fabric layers is maintained.

A fourth embodiment of the present invention provides that at least one lower machine direction yarn is arranged between consecutive machine direction binder yarn pairs. In addition, at least one, for example two, upper cross machine direction yarns may be arranged between consecutive cross machine direction binder yarn pairs, thereby providing an optimum compromise between uniformity of the top woven fabric layer and a secure connection between the woven fabric layers.

A fifth embodiment of the present invention provides that at least one, for example two, lower cross machine direction yarns are arranged between consecutive cross machine direction binder yarns. Since, as a rule, the bottom woven fabric layer provides the machine side of the paper machine clothing, the wear volume and therefore the lifespan of the paper machine fabric according to the present invention is clearly increased.

A sixth embodiment of the present invention provides that the cross machine direction yarns are arranged in the following sequence between consecutive cross machine direction binder yarns:

a first upper cross machine direction yarn;
a first lower cross machine direction yarn;
a second upper cross machine direction yarn; and
a second lower cross machine direction yarn.

The top woven fabric layer may form a linen weave. This provides a paper machine fabric with an especially mark-free paper side.

Crossover points often represent interruptions in the woven structure, which is why the dewatering properties at these crossover points of the forming fabric often differ from the dewatering properties of the woven fabric next to the crossover points. The different dewatering behavior results in markings of the paper which is being formed on the forming fabric. These are especially visible if they are located uniformly, for example in diagonals. In order to achieve an irregular placement of the crossover points, the weaving pattern of the paper machine fabric may repeat in register, whereby one register includes 50 or more, for example 72 or more, cross machine direction yarns and 30 or more, for example 48 or more, machine direction yarns.

The lower cross machine direction yarns may have a larger diameter than the upper cross machine direction yarns and the binding cross machine direction yarns. This increases the wear volume of the non-load absorbing machine side cross machine direction yarns, thereby increasing the wear resistance of the paper machine fabric according to the present invention.

In order to clearly reduce the marking characteristic described above which is caused by the uniform placement of the crossover points, a seventh embodiment of the present invention provides crossover points of consecutive machine direction binder yarn pairs within a repeat are offset relative to each other. There are consecutive machine direction binder yarn pairs whose crossover points are offset relative to each other by a first count of upper weaving paths extending in cross machine direction, whereby there are consecutive machine direction binder yarn pairs whose crossover points are offset relative to each other by a second count of upper weaving paths extending in the cross machine direction and whereby the second count is different from the first count. Generally this means that, within a repeat, the crossover points of a machine direction binder yarn pair relative to the crossover points of an immediately adjacent machine direction binder yarn pair can be offset by a first count, whereas the crossover points of another machine direction binder yarn pair can be offset by a different second count relative to the crossover points of an immediately adjacent machine direction binder yarn pair.

An eighth embodiment of the present invention provides that the offset within the repeat occurs as follows:

between a first and a second machine direction binder yarn pair the offset of the crossover points amounts to the first count;
between the second and a third machine direction binder yarn pair the offset of the crossover points amounts to the second count;
between a third and a fourth machine direction binder yarn pair the offset of the crossover points amounts to the second count; and
between the fourth and a fifth machine direction binder yarn pair the offset of the crossover points amounts to the second count.

A concrete embodiment of the present invention which is based upon this provides that the first count is six or more and the second count is eight or more. In this connection, the present invention further provides that, within a repeat, crossover points of successive cross machine direction binder yarn pairs are offset relative to each other, whereby there are consecutive cross machine direction binder yarn pairs whose crossover points are offset relative to each other by a third count of upper weaving paths extending in machine direction, whereby there are consecutive weft binder yarn pairs whose crossover points are offset relative to each other by a fourth count of upper weaving paths extending in machine direction and whereby the fourth count is different from the third count.

"Concrete" in this connection is to be understood to mean, for example, that the offset repeats within the repeat as follows:

between a first and a second cross machine direction binder yarn pair the offset of the crossover points is the third count; and
between the second and a third cross machine direction binder yarn pair the offset of the crossover points is the fourth count.

For example, the third count may be three or more and the fourth count may be five or more. The machine direction yarns may, for example, be warp yarns and the cross machine direction yarns may be weft yarns.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
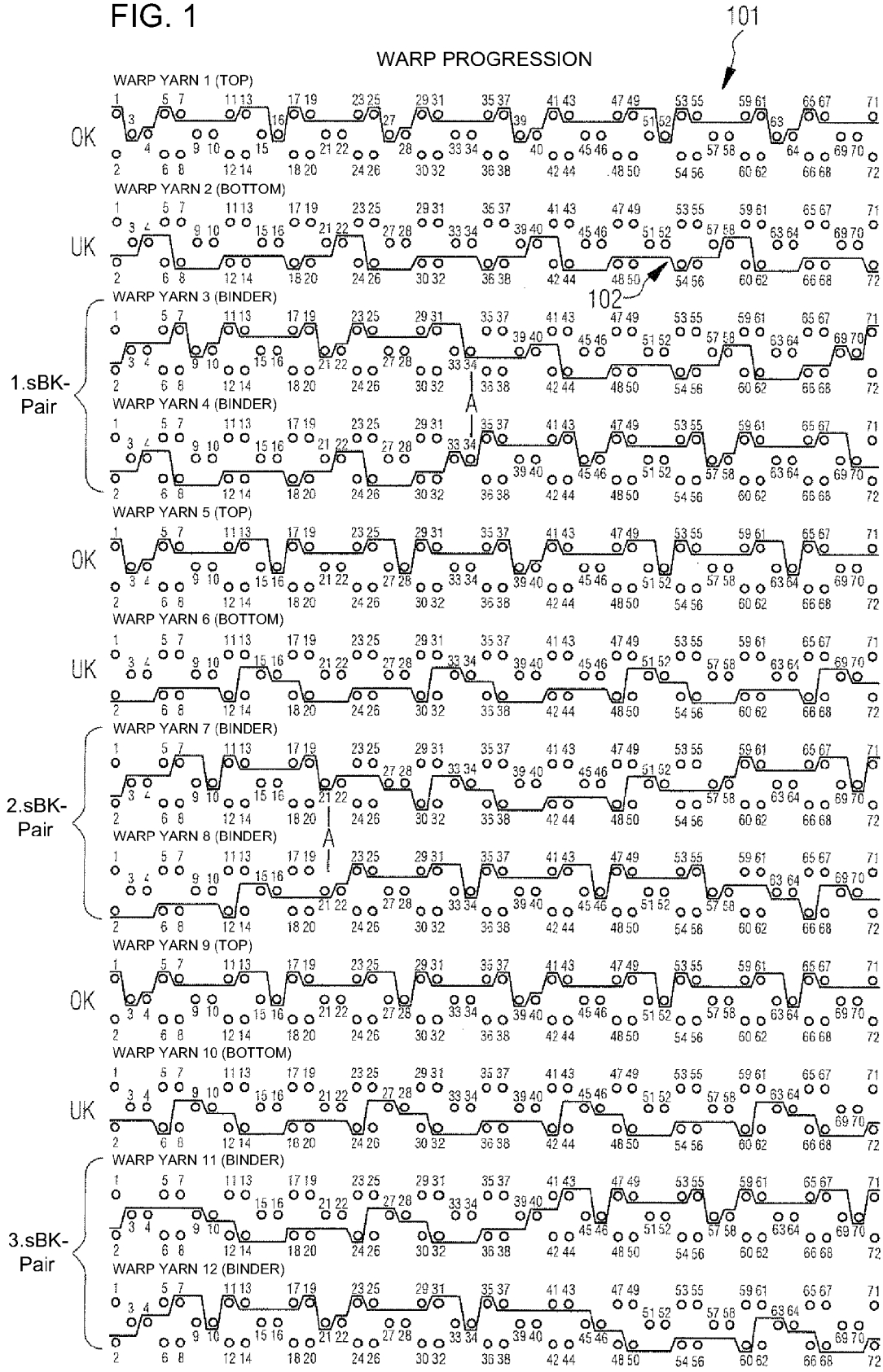
FIGS. 1, 1*a* -1*c* illustrates a warp progression of a paper machine fabric according to the present invention.
Figure 1A:
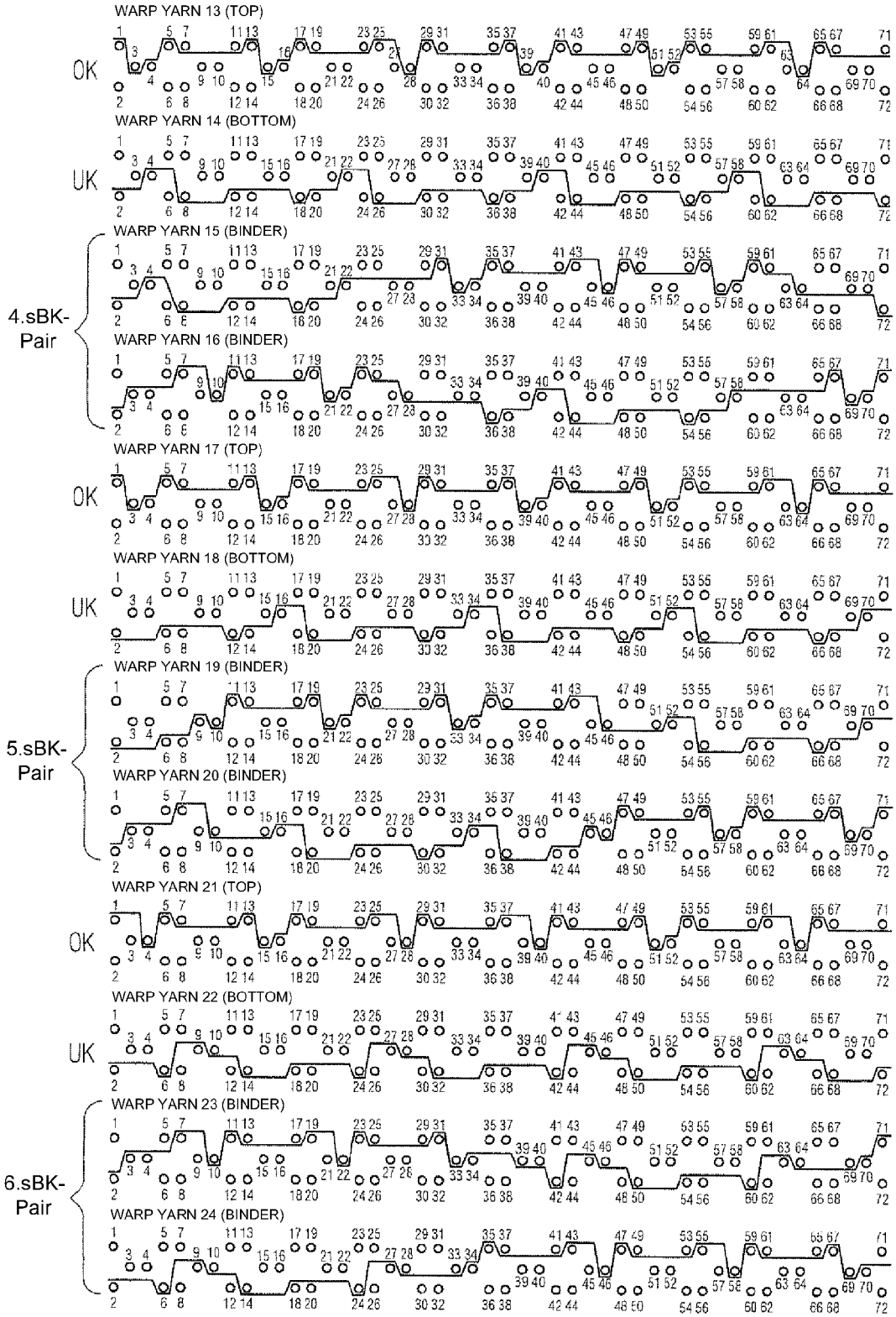
Figure 1B:
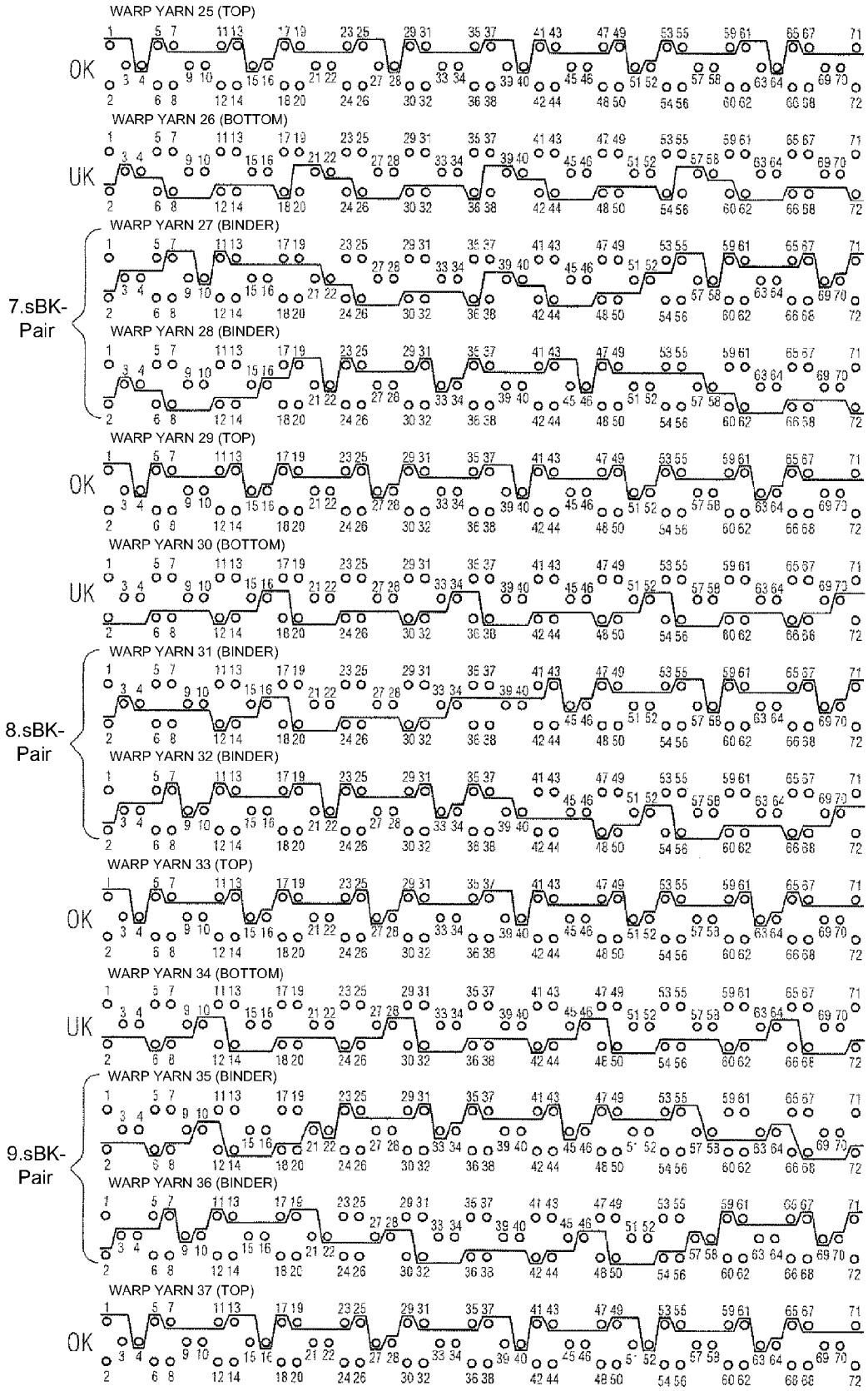
Figure 1C:
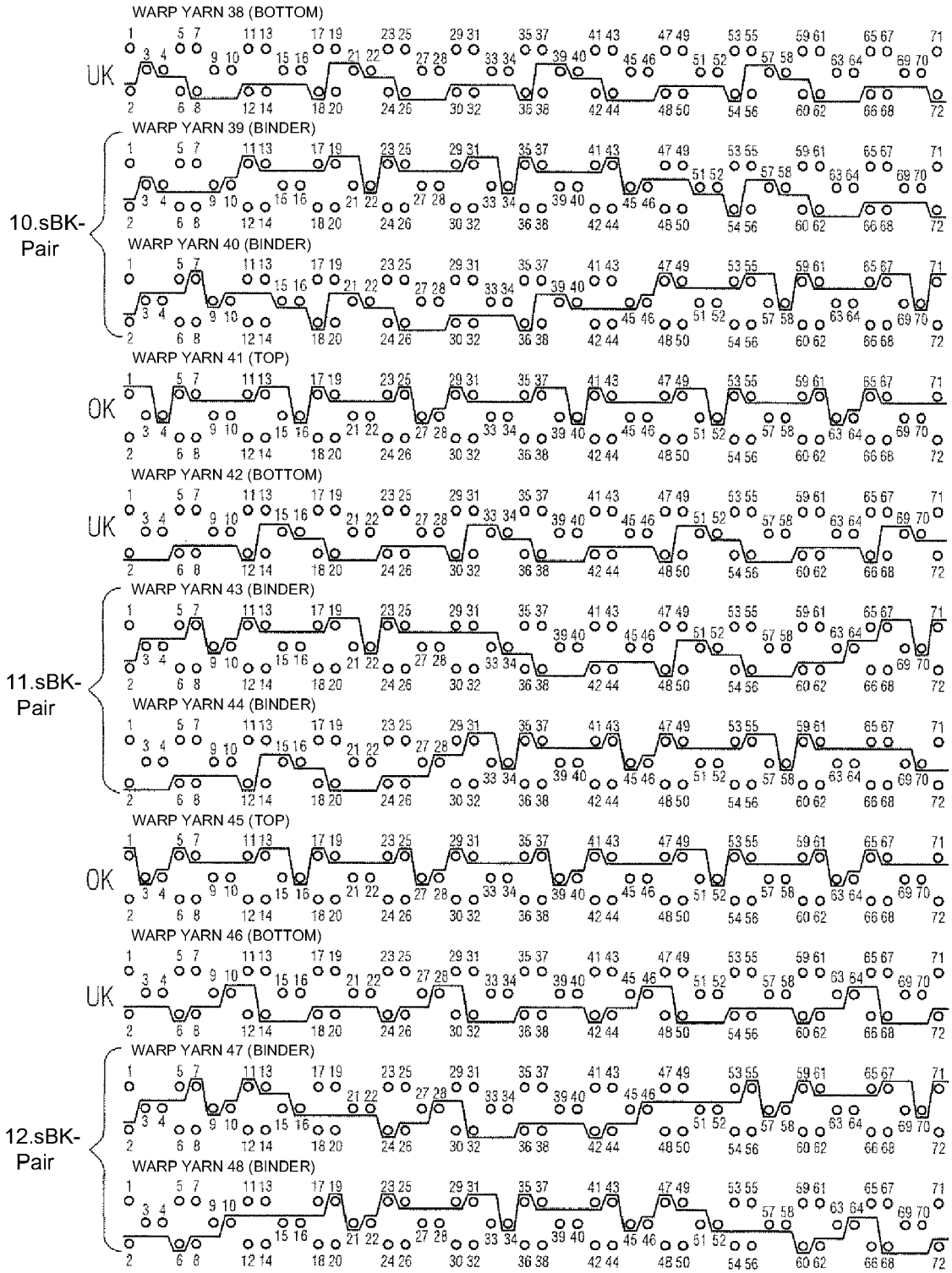
Figure 2:
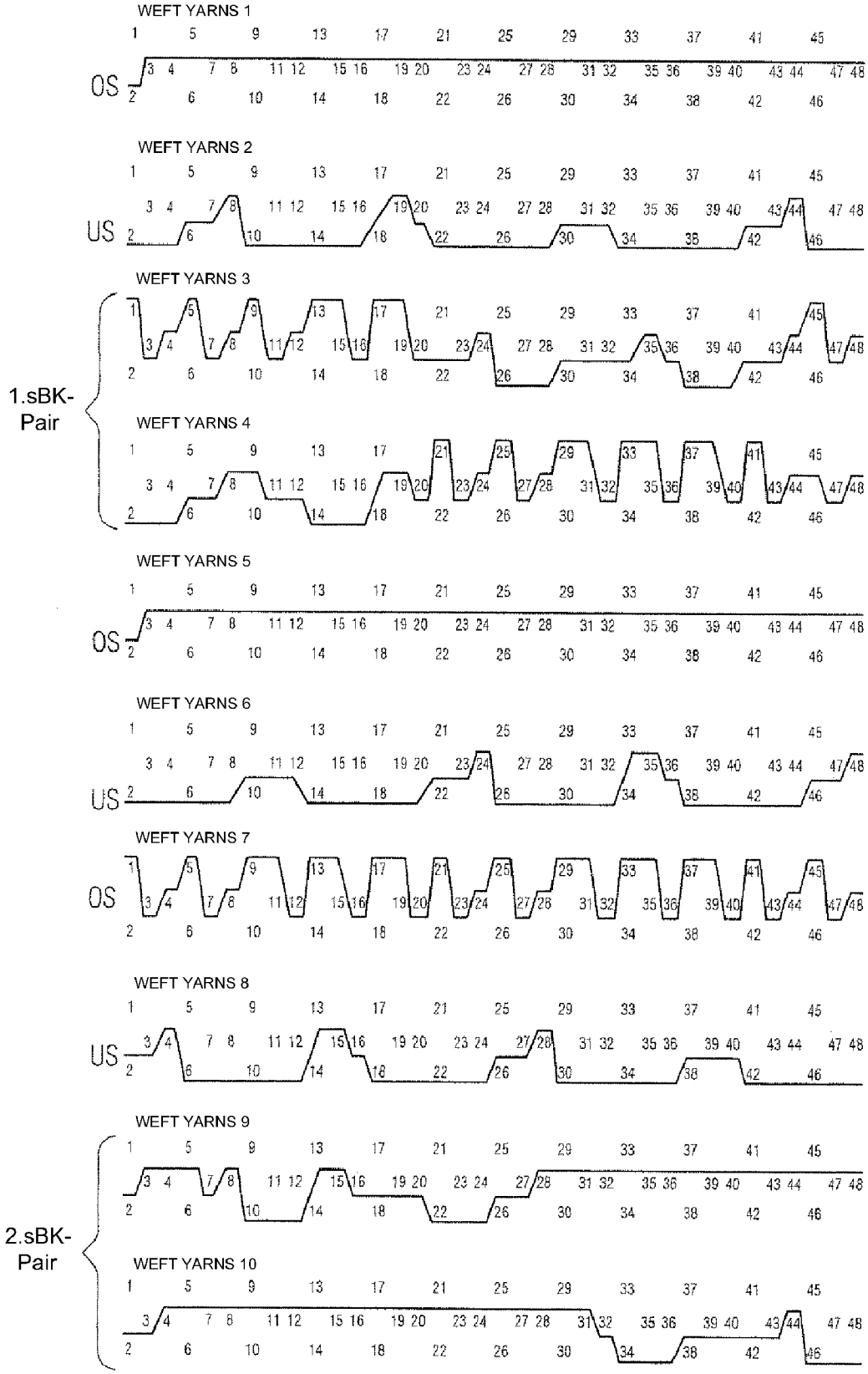
FIGS. 2, 2*a*-2*f* illustrates a weft progression of the paper machine fabric according to the present invention illustrated in FIGS. 1, 1*a*-1*c;*
Figure 2A:
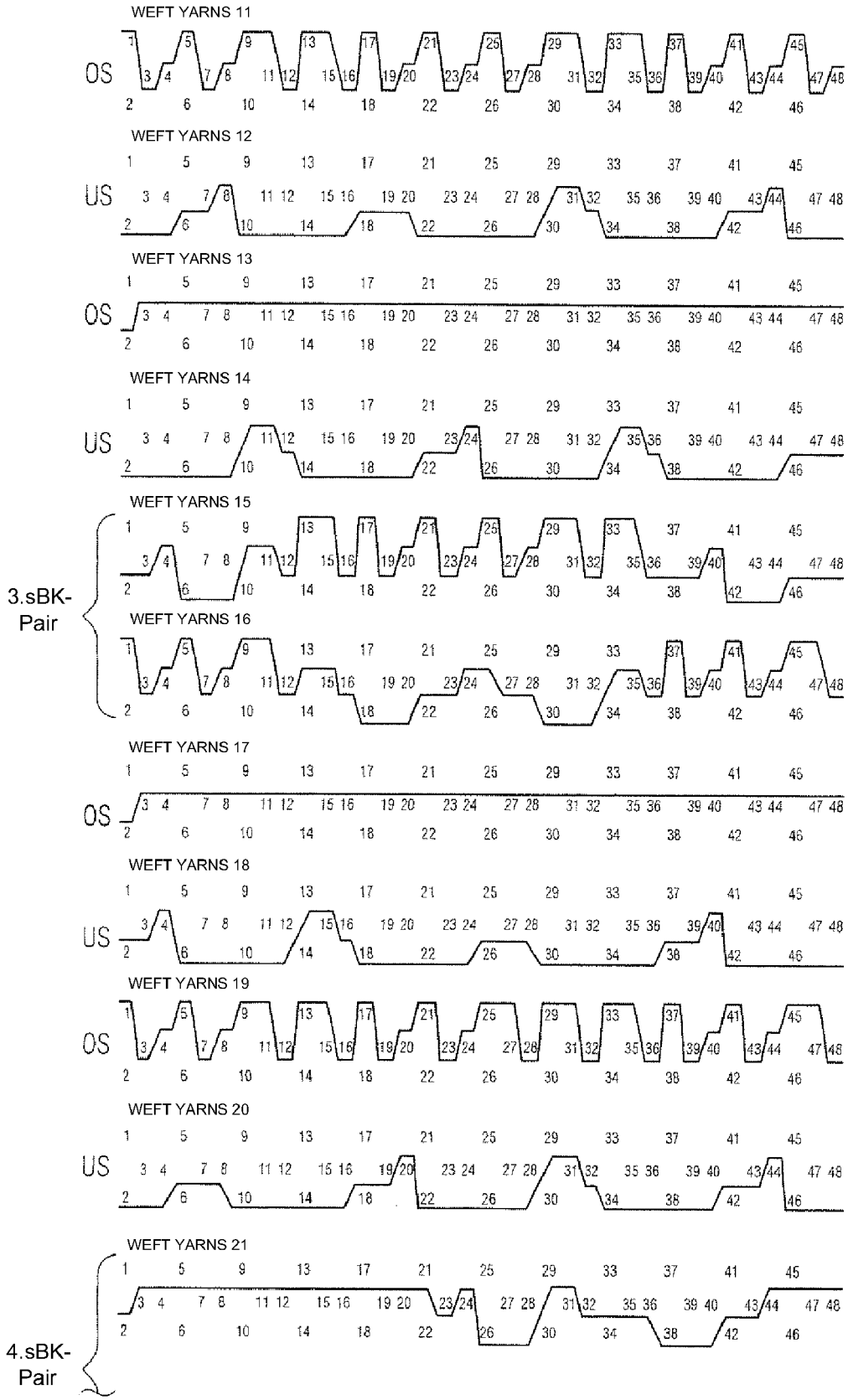
Figure 2B:
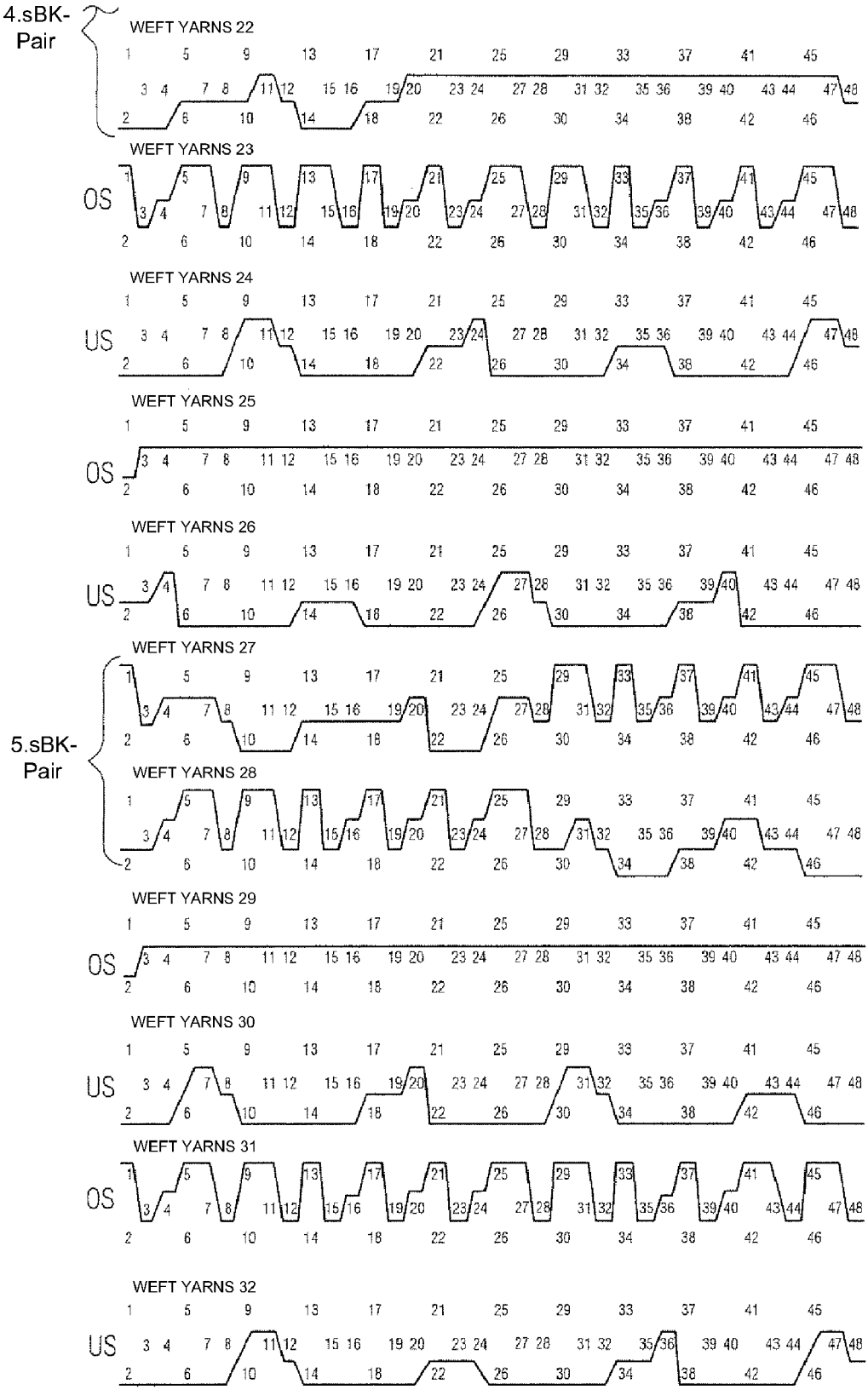
Figure 2C:
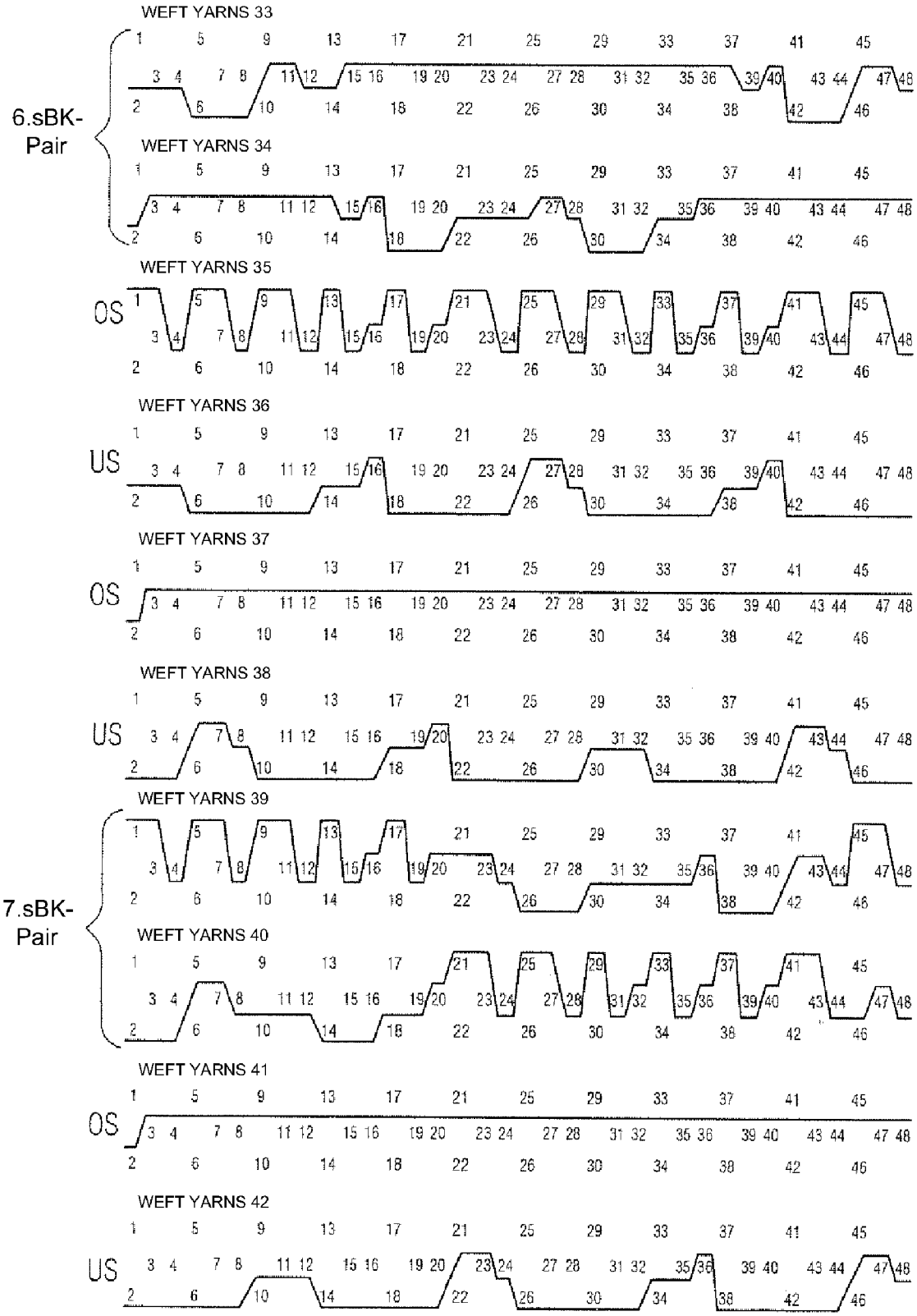
Figure 2D:
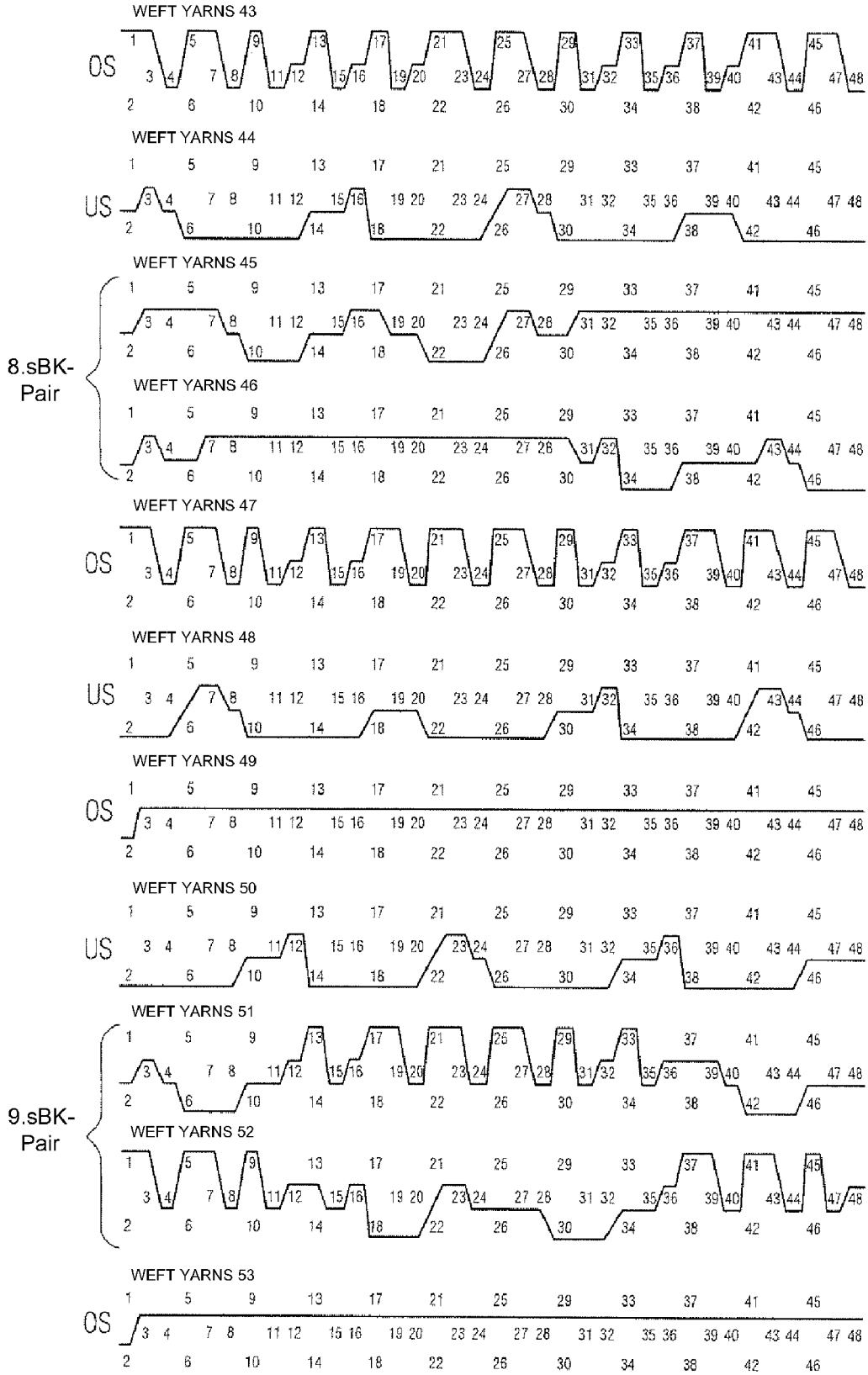
Figure 2E:
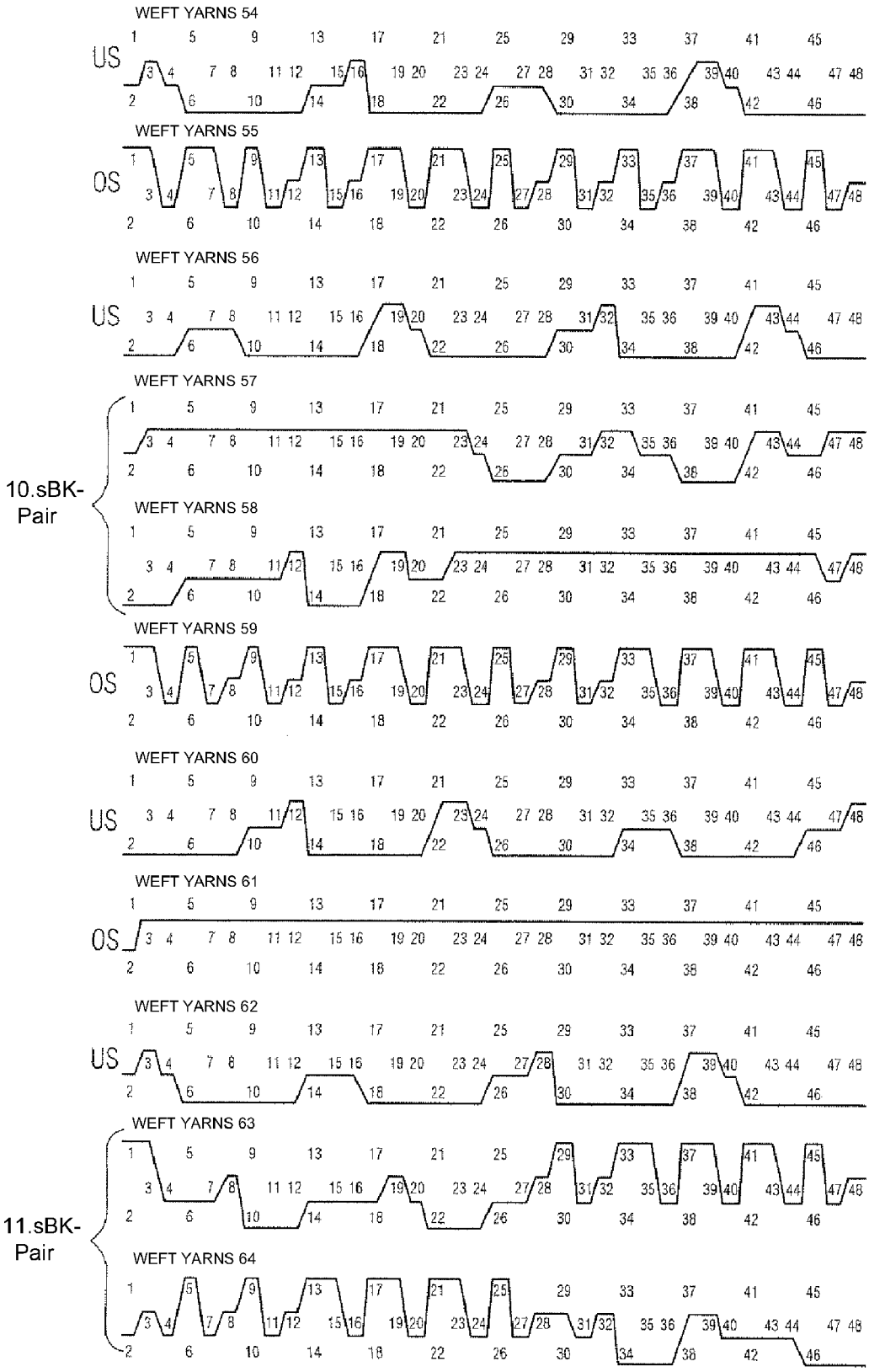
Figure 2F:
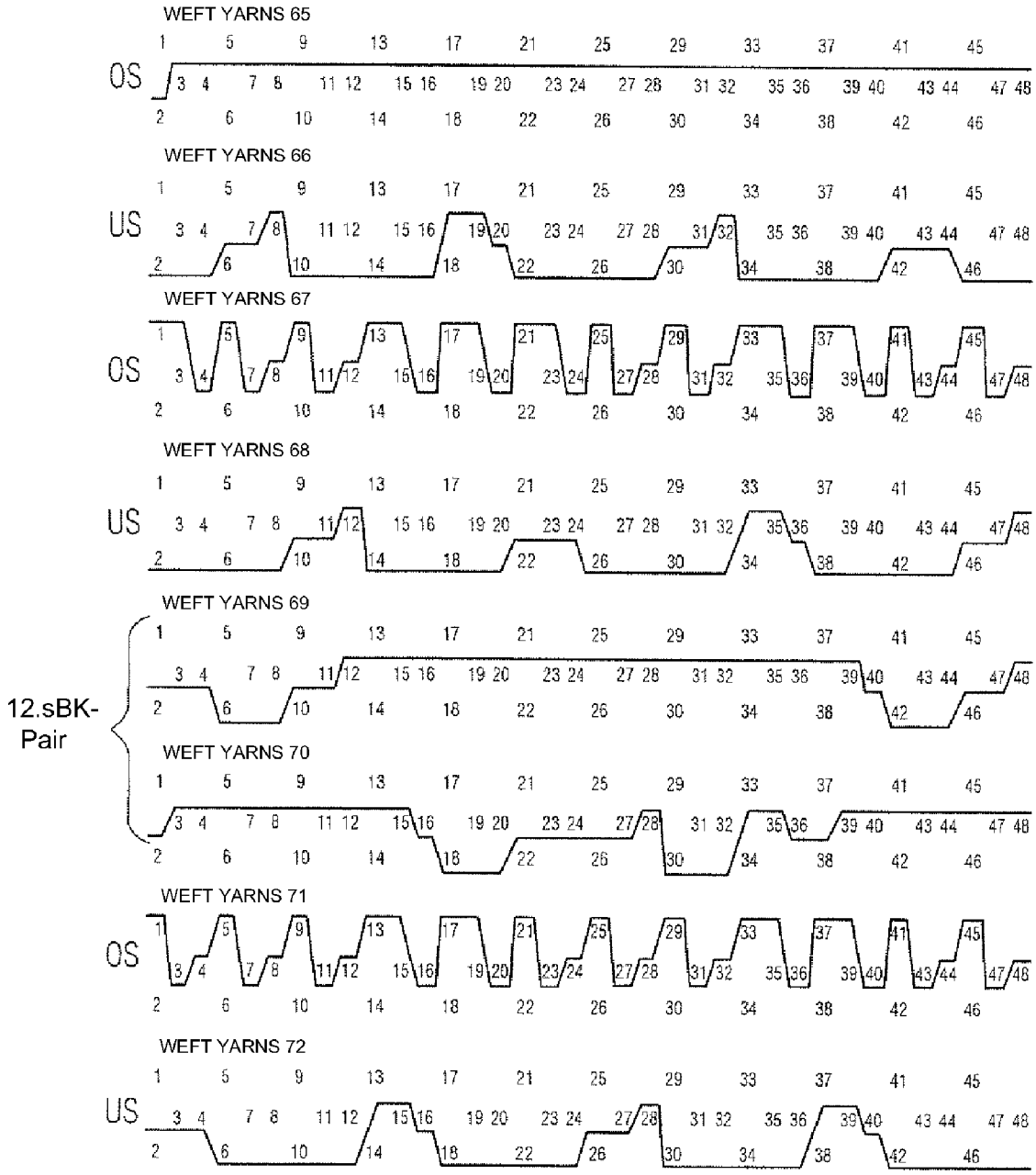

Referring now to the drawings, and more particularly to FIG. 1 (herein collectively referring to FIGS. 1, 1*a*-1*c*), there is shown a warp progression of a paper machine fabric according to the present invention, embodied as forming fabric 100. FIG. 2 (herein collectively referring to FIGS. 2, 2*a*-2*f*) further illustrates the weft yarn progression in forming fabric 100. The various weft yarns are illustrated in FIG. 1 by circles. The numbering of the weft yarns corresponds to the numbering of the weft yarns in FIG. 2. In addition, the various warp yarns are illustrated by circles in the depiction in FIG. 2. The numbering of the warp yarns corresponds to the numbering of the warp yarns in FIG. 1. Forming fabric 100 includes, in one repeat machine direction, yarns embodied as warp yarns 1-48, as well as cross machine direction yarns embodied as weft yarns 1-72.

The current example includes:

warp yarns 1, 5, 9, 13, 17, 21, 25, 29, 33, 37, 41 and 45 upper warp yarns "OK", warp yarns 2, 6, 10, 14, 18, 22, 26, 30, 34, 38, 42 and 46 lower warp yarns "UK", warp yarns 3 and 4, 7 and 8, 11 and 12, 15 and 16, 19 and 20, 23 and 24, 27 and 28, 31 and 32, 35 and 36, 39 and 40, 43 and 44, 47 and 48 are binding warp yarns "sBK", which are always arranged in pairs.

In addition weft yarns 1, 5, 7, 11, 13, 17, 19, 23, 25, 29, 31, 35, 37, 41, 43, 47, 49, 53, 55, 59, 61, 65, 67 and 71 upper weft yarns "OS", weft yarns 2, 6, 8, 12, 14, 18, 20, 24, 26, 30, 32, 36, 38, 42, 44, 48, 50, 54, 56, 60, 62, 66, 68, and 72 lower weft yarns "US", weft yarns 3 and 4, 9 and 10, 15 and 16, 21 and 22, 27 and 28, 33 and 34, 39 and 40, 45 and 46, 51 and 52, 57 and 58, 63 and 64, 69 and 70 are binding weft yarns "sBS", which are always arranged in pairs.

Forming fabric 100 includes top woven fabric layer 101 which provides the paper side of forming fabric 100 and which is formed in that upper warp yarns OK, upper weft yarns OS, the binding weft yarns sBS and binding warp yarns sBK are interwoven. Top woven fabric layer 101 hereby forms a linen weave. In addition, forming fabric 100 includes bottom woven fabric layer 102 which provides the machine side of forming fabric 100 and which is formed in that lower warp yarns UK, lower weft yarns US, binding weft yarns sBS and binding warp yarns sBK are interwoven with each other.

Woven fabric layers 101 and 102 are hereby connected with each other by means of binding warp yarns sBK which are arranged in pairs and by binding weft yarns sBS which are arranged in pairs, whereby the binder yarns of one binder yarn pair (sBS-pair and sBK-pair) together provide an upper weaving path during weaving of the top woven fabric layer in that each binder yarn sBK or sBS respectively of the binder yarn pair alternatively weaves top 101 and bottom 102 woven fabric layer. While the first binder yarn of the binder yarn pair weaves top fabric layer 101 the second binder yarn of the binder yarn pair weaves bottom fabric layer 102 and while the second binder yarn weaves the top fabric layer, the first binder yarn weaves bottom fabric layer 102 and whereby binder yarns sBS, sBK of the binder yarn pair cross over each other, thereby creating crossover points A when the first binder yarn changes over from interweaving of top fabric layer 101 to interweaving bottom fabric layer 102, and the second binder yarn changes over from interweaving bottom fabric layer 102 to interweaving top fabric layer 101, and vice versa.

As can be seen in the illustration in FIG. 1, each of binding warp yarns sBK interweaves with several upper weft yarns OS and with several binding weft yarns sBS during weaving of top fabric layer 101 before changing over at a crossover point to weaving bottom fabric layer 102.

As can be further seen in the illustration in FIG. 2 each of binding weft yarns sBS interweaves with several upper warp yarns OK and with several binding warp yarns sBK when weaving top fabric layer 101, before changing over at the crossover point to weaving bottom fabric layer 102. In addition, binder yarns sBK and sBS respectively are structure forming binder yarns since they continue the weaving pattern through interweaving of the upper warp yarns with the upper weft yarns. Consequently, binding warp yarns sBK are interwoven with upper weft yarns OS, with lower weft yarns US and with binding weft yarns sBS. In addition, binding weft yarns sBS are interwoven with upper warp yarns OK, with lower warp yarns UK and with binding warp yarns sBK. As can be seen from the illustration in FIG. 1, an upper warp yarn OK is always arranged between consecutive warp binder yarn pairs, 1.sBK-pair-12.sBK-pair. In addition, a lower warp yarn UK is arranged between consecutive warp binder yarn pairs, 1.sBK-pair-12.sBK-pair.

As can be seen from the illustration in FIG. 2, two upper weft yarns OS are arranged between consecutive weft binder yarn pairs 1.sBS-pair-12.sBS pair, and two lower weft yarns US are arranged between consecutive weft binder yarn pairs 1.sBS pair-12.sBS pair.

The sequence of the arrangement is hereby, for example, as follows: between a first weft binder yarn pair, for example, 1.sBS-pair and a consecutive second weft binder yarn pair, for example, 2.sBS-pair the weft yarns are arranged in the following sequence:

Upper weft yarn 5, lower weft yarn 6, upper weft yarn 7, lower weft yarn 8.

As can be seen in the illustration in FIG. 1, lower weft yarns US have a larger diameter than upper weft yarns OS and binding weft yarns sBS.

Figure 3:
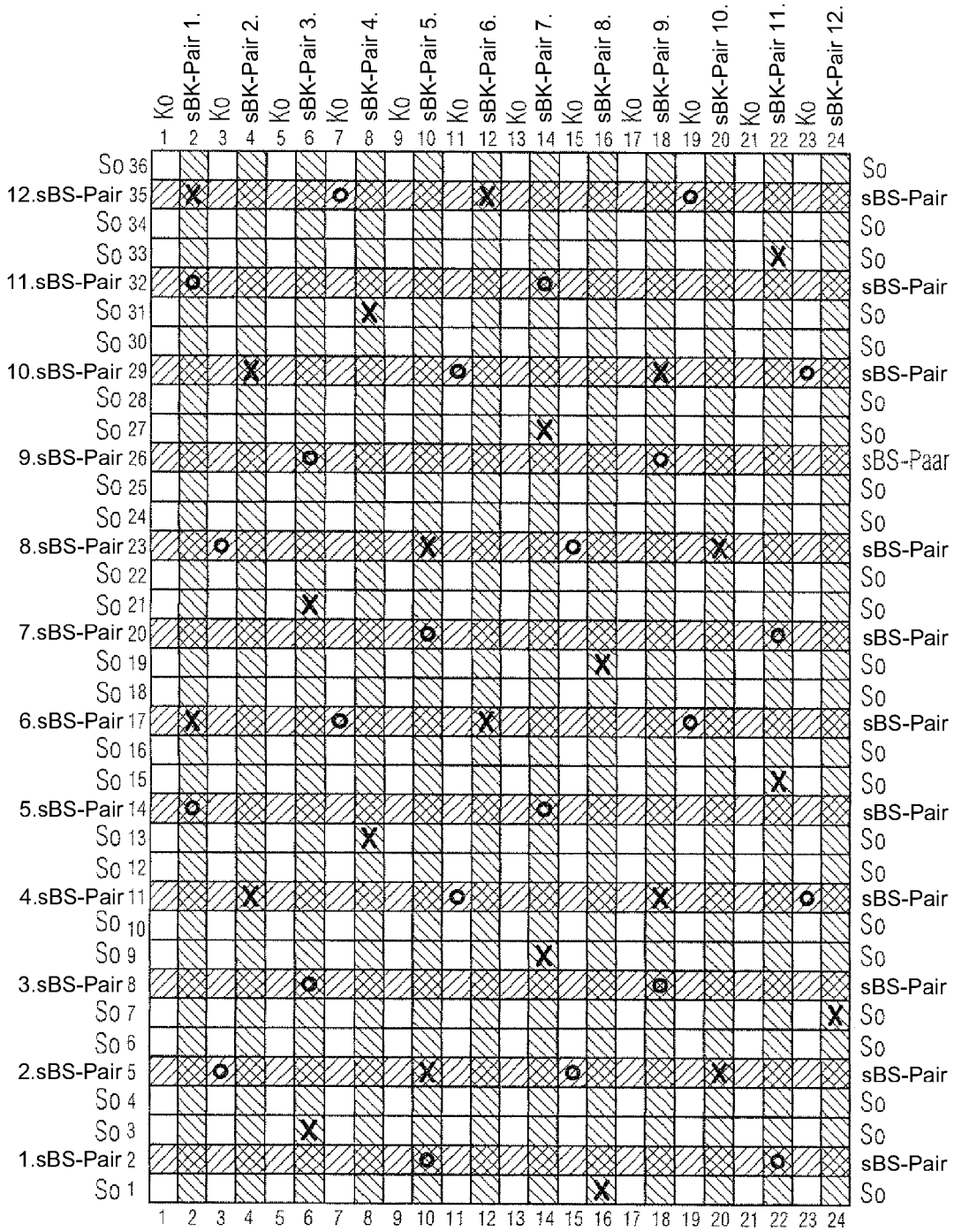
FIG. 3 illustrates placement of the crossover points of the paper machine fabric according to the present invention illustrated in FIGS. 1, 1*a*-1*c* and FIGS. 2, 2*a*-2*f*.

FIG. 3 illustrates the arrangement of the crossover points of forming fabric 100 illustrated in FIGS. 1 and 2. As can be seen in the illustration in FIG. 3, crossover points X of consecutive warp binder yarn pairs "sBK-pairs" are offset relative to each other inside the repeat area, whereby the offset repeats in a 6-8-8-8 sequence, as can be seen in the following example:

between a first warp binder pair, for example 1.sBK-pair, and a second warp binder yarn pair, for example 2.sBK-pair, the offset of crossover points X amounts to six upper weaving paths, for example OS 34, OS33, 11.s.BS-pair, OS31-OS29, extending weftwise;

between the second warp binder yarn pair, for example 2.sBK-pair, and a third warp binder yarn pair, for example 3.sBK-pair, the offset of crossover points X amounts to eight upper weaving paths, for example OS 28, OS27, 9.sBS-pair, OS25, OS24, 8s.BS-pair, OS22, OS21, extending weftwise;

between the third warp binder yarn pair, for example 3.sBK-pair, and a fourth warp binder yarn pair, for example 4.sBK-pair, the offset of crossover points X amounts to eight upper weaving paths, for example 7.sBS-pair, OS 19, OS18, 6.sBS-pair, OS16, OS15, 5s.BS-pair, OS13, extending weftwise; and between the fourth warp binder yarn pair, for example 4.sBK-pair, and a fifth warp binder yarn pair, for example 5.sBK-pair, the offset of crossover points X amounts to eight upper weaving paths, for example OS 12, 4.sBS-pair, OS10, OS9, 3s.BS-pair, OS7, OS6, 2.sBS-pair, extending weftwise.

In addition, crossover points O of consecutive weft binder yarn pairs "sBS-pairs" are offset relative to each other inside the repeat, whereby the offset repeats in a 3-5 sequence as can be seen in the following example:

between a first weft binder yarn pair, for example 8.sBS-pair, and a second weft binder yarn pair, for example 9.sBS-pair, the offset of crossover points O amounts to three upper weaving paths, for example 2.sBK-pair, OK5, 3.sBK-pair, extending warpwise, between the second weft binder yarn pair, for example 9.sBS-pair, and a third weft binder yarn pair, for example "10.sBS-pair", the offset of crossover points O amounts to five upper weaving paths, for example OK7, 4.sBK-pair, OK9, 5sBK-pair, OK11, extending warpwise.

Figure 4:
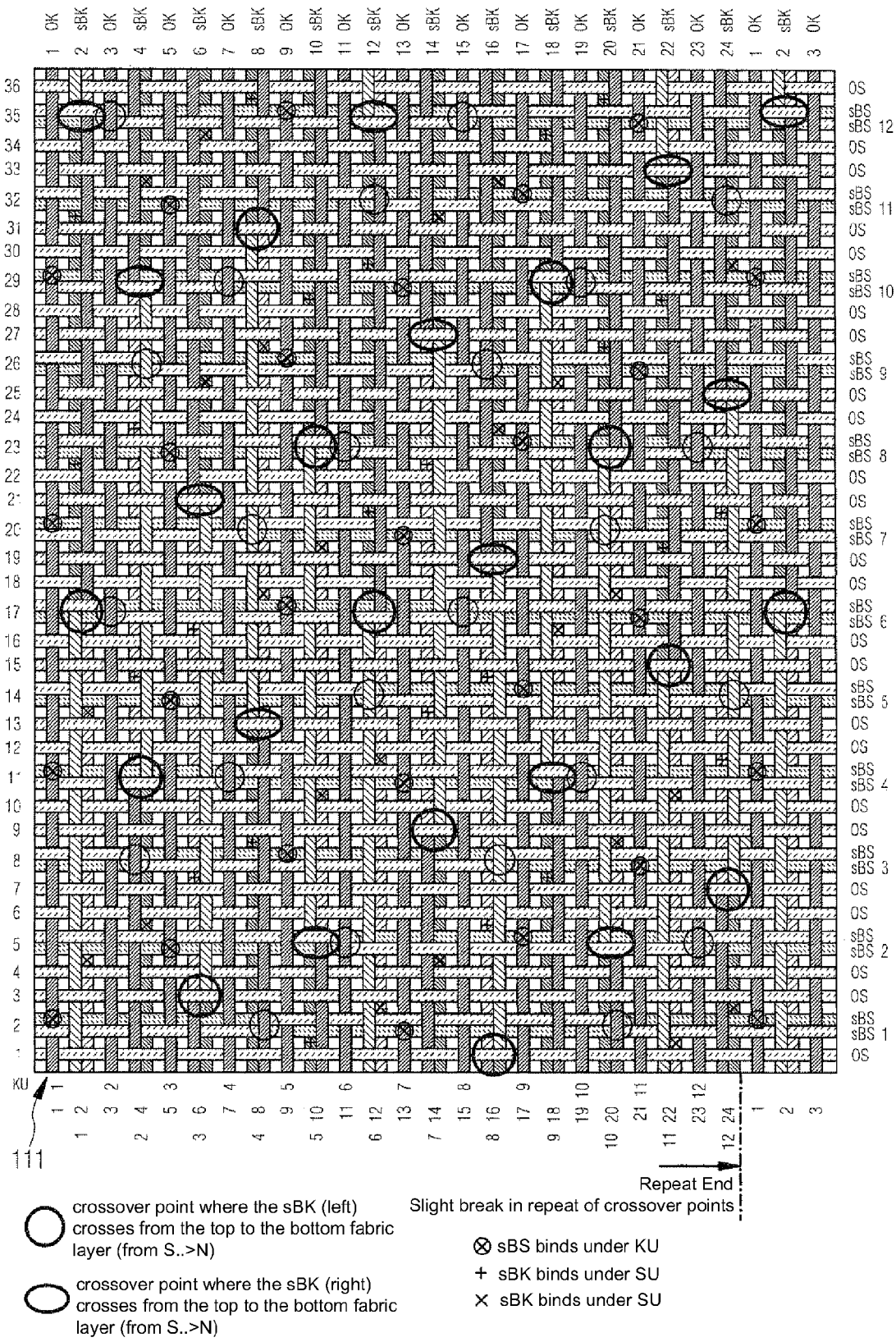
FIG. 4 illustrates a second design variation of a paper machine fabric according to the present invention, with a view onto the paper side.

Referring now to FIG. 4, there is shown a second design variation of paper machine fabric according to the present invention in the embodiment of forming fabric 110 with a view onto top woven fabric layer 111, which provides the paper side.

Top woven fabric layer 111 of forming fabric 110 presents a linen weave. According to the present invention, the connection between top woven fabric layer 111 and the lower—not illustrated—woven fabric layer of forming fabric 110 is provided by binding warp yarns sBK which are arranged in pairs and by binding weft yarns sBS which are arranged in pairs, whereby binder yarns sBK, or sBS respectively of a binder yarn pair together provide an upper weaving path during weaving of top woven fabric layer 111, in that each binder yarn sBK or sBS respectively of the binder yarn pair alternatively weaves the top and the bottom woven fabric layer. Top woven fabric layer 111 is formed predominantly by upper warp yarns OK, upper weft yarns OS, binding warp yarns sBK and binding weft yarns which are interwoven with each other. Interweaving of binder yarns sBS, or sBK respectively continues the weaving pattern which is created by interweaving of upper warp yarns OK with upper weft yarns OS. Binder yarns sBS and sBK respectively are therefore "structure forming binder yarns". The crossover points of each binder yarn pair where first binder yarn sBS and sBK respectively of the pair changes over from interweaving top woven fabric layer 111 to interweaving the bottom woven fabric layer, and second binder yarn sBS and sBK respectively of the pair changes over from interweaving the bottom woven fabric layer to interweaving top fabric layer 111, and vice versa are identified by circles. Hereby the crossover points of binding weft yarns sBS of a pair are shown by light circles and crossover points of the binding warp yarns sBK of a pair are shown by dark circles.

In this second design variation of the paper machine fabric according to the present invention, in the embodiment of forming fabric 110 the number of machine side tie-points which are created per surface unit by yarn pairs progressing in machine cross direction is fewer than the number of the machine side tie-points which are created per surface unit by yarn pairs progressing in machine direction. This second design variation of the paper machine fabric according to the present invention, in the embodiment of forming fabric 110, may also provide that the absolute distance of the machine side tie-points which are formed by at least one yarn pair progressing in machine direction is greater than the absolute distance of the machine side tie-points which are formed by at least one yarn pair progressing in cross machine direction.

In both of the aforementioned cases a ratio of >1:1 results of the machine side tie-point distance of the yarn pair progressing in machine direction relative to the machine side tie-point distance of the yarn pair progressing in cross machine direction. The result of this is that the paper machine fabric according to the present invention in the embodiment of forming fabric 110 possesses great rigidity in the cross machine direction, but has the necessary flexibility in the machine direction which is required to wrap around at least one roll at high speeds. This causes a relative movement in forming fabric 110, in other words a compression of the side which is in contact with the machine and stretching on the side in contact with the paper, and additionally a lower load absorption of the paper machine. The respective yarn pair can also be a yarn triplet, etc.

The described design variations may also provide that the binder yarns are arranged symmetrically, in other words so that the tie-point on the machine side is always at the same distance to the imaginary center of the binding sequence on the paper side. However, other binding sequences may also be used with which other progressions are realized. This can then be expressed in different binder yarn-weft yarn ratios or respectively binder yarn-warp ratios.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine fabric, comprising:

a top woven fabric layer; and a bottom woven fabric layer connected with said top woven fabric layer by a plurality of paired binder yarns, at least one of said binder yarn pairs including a plurality of binding machine direction yarns, and at least one other of said binder yarn pairs including a plurality of binding cross machine direction yarns wherein said top woven fabric layer includes a plurality of upper machine direction yarns and a plurality of upper cross machine direction yarns, said upper machine direction yarns being interwoven with said upper cross machine direction yarns and with said binding cross machine direction yarns of at least one of said at least one binder yarn pairs and said upper cross machine direction yarns being interwoven with said upper machine direction yarns and with said binding machine direction yarns of at least one of said at least one binder yarn pairs.

2. The paper machine fabric according to claim 1, wherein said binder yarns of at least one of said binder yarn pairs together provide an upper weaving path in a weaving of said top woven fabric layer whereby each of said binder yarns of said one of said binder yarn pair alternatively weaves said top woven fabric layer and said bottom woven fabric layer, said one of said binder yarn pairs includes a first binder yarn and a second binder yarn, while said first binder yarn weaves said top fabric layer said second binder yarn weaves said bottom fabric layer and while said second binder yarn weaves said top fabric layer said first binder yarn weaves said bottom fabric layer, whereby said first binder yarn and said second binder yarn cross over each other to form crossover points when said first binder yarn changes from interweaving said top fabric layer to interweaving said bottom fabric layer and when said second binder yarn changes over from interweaving said bottom fabric layer to interweaving said top fabric layer.

3. The paper machine fabric according to claim 2, wherein said top woven fabric layer includes only interweaving of said binding machine direction yarns with said binding cross machine direction yarns.

4. The paper machine fabric according to claim 3, wherein said bottom woven fabric layer includes a plurality of lower cross machine direction yarns and a plurality of lower machine direction yarns, said bottom woven fabric layer including one of an interweaving of said binding machine direction yarns with said binding cross machine direction yarns and with said lower cross machine direction yarns and an interweaving of said binding cross machine direction yarns with said binding machine direction yarns and with said lower machine direction yarns.

5. The paper machine fabric according to claim 1, wherein said lower machine direction yarns are interwoven with said lower cross machine direction yarns and with said binding cross machine direction yarns and whereby said lower cross machine direction yarns are interwoven with said lower machine direction yarns and with said binding machine direction yarns.

6. The paper machine fabric according to claim 5, wherein said binding machine direction yarns are interwoven with said upper cross machine direction yarns, said lower cross machine direction yarns and said binding cross machine direction yarns.

7. The paper machine fabric according to claim 6, wherein said binding cross machine direction yarns are interwoven with said upper machine direction yarns, said lower machine direction yarns and said binding machine direction yarns.

8. The paper machine fabric according to claim 7, wherein said at least one binding machine direction yarn pair is a plurality of machine direction binder yarn pairs consecutively arranged, at least one of said upper machine direction yarns being arranged between said consecutive machine direction binder yarn pairs.

9. The paper machine fabric according to claim 8, wherein at least one of said lower machine direction yarns is arranged between said consecutive machine direction binder yarn pairs.

10. The paper machine fabric according to claim 9, wherein said at least one other cross machine direction binding pair is a plurality of cross machine direction binder yarn pairs consecutively arranged, at least one of said upper cross machine direction yarns being arranged between said between said consecutive cross machine direction binder yarn pairs.

11. The paper machine fabric according to claim 10, wherein two of said upper cross machine direction yarns are arranged between said consecutive cross machine direction binder yarn pairs.

12. The paper machine fabric according to claim 11, wherein at least one of said lower cross machine direction yarns is arranged between said consecutive cross machine direction binder yarn pairs.

13. The paper machine fabric according to claim 12, wherein two of said lower cross machine direction yarns are arranged between said consecutive cross machine direction binder yarn pairs.

14. The paper machine fabric according to claim 13, wherein said cross machine direction yarns are arranged in a sequence between said consecutive cross machine direction binder yarns, said sequence including:

a first upper cross machine direction yarn;

a first lower cross machine direction yarn;

a second upper cross machine direction yarn; and a second lower cross machine direction yarn.

15. The paper machine fabric according to claim 1, wherein a weaving pattern in said paper machine fabric repeats in register, whereby one said register includes at least 50 of said cross machine direction yarns and at least 30 of said machine direction yarns.

16. The paper machine fabric according to claim 15, wherein said one register includes at least 72 of said cross machine direction yarns and at least 48 of said machine direction yarns.

17. The paper machine fabric according to claim 13, wherein a diameter of said lower cross machine direction yarns is larger than a second diameter of said upper cross machine direction yarns and a third diameter of said binding cross machine direction yarns.

18. The paper machine fabric according to claim 17, wherein a plurality of said crossover points of said consecutive machine direction binder yarn pairs within a repeat are offset relative to each other and include a first set of said consecutive machine direction binder yarn pairs having a first set of crossover points being offset relative to each other by a first count of a plurality of upper weaving paths extending in a cross machine direction and a second set of said consecutive machine direction binder yarn pairs having a second set of crossover points being offset relative to each other by a second count of said upper weaving paths extending in said cross machine direction, said second count being different from said first count.

19. The paper machine fabric according to claim 18, wherein offsets of said plurality of said crossover points of said consecutive machine direction binder yarn pairs within said repeat occur as follows:

between a first binding machine direction yarn pair and a second binding machine direction yarn pair said crossover points are offset by said first count;

between said second binder machine direction yarn pair and a third machine direction binder yarn pair said crossover points are offset by said second count;

between said third machine direction binder yarn pair and a fourth machine direction binder yarn pair said crossover points are offset by said second count; and between said fourth machine direction binder yarn pair and a fifth machine direction binder yarn pair said crossover points are offset by said second count.

20. The paper machine fabric according to claim 19, wherein said first count is at least six and said second count is at least eight.

21. The paper machine fabric according to claim 20, wherein within said repeat said crossover points of said cross machine direction binder yarn pairs successively arranged are offset relative to each other, whereby said repeat includes said cross machine direction binder yarn pairs consecutively arranged having crossover points offset relative to each other by a third count of a plurality of said upper weaving paths extending in a machine direction and whereby said repeat includes said a plurality of weft binder yarn pairs consecutively arranged and having crossover points offset relative to each other by a fourth count of said upper weaving paths extending in said machine direction, said fourth count being different from said third count.

22. The paper machine fabric according to claim 21, wherein said offset repeats with said repeat, said offset of said crossover points between said first cross machine direction binder yarn pair and said second cross machine direction binder yarn pair being said third count and said offset of said crossover points between said second cross machine direction binder yarn pair and said third cross machine direction binder yarn pair being said fourth count.

23. The paper machine fabric according to claim 22, wherein said third count is at least three and said fourth count is at least five.

24. The paper machine fabric according to claim 23, wherein said machine direction yarns are warp yarns and said cross machine direction yarns are weft yarns.

25. The paper machine fabric according to claim 1, wherein said paper machine fabric is a forming fabric.

* * * * *